United States Patent [19]

Johnson et al.

[11] 3,962,382

[45] June 8, 1976

[54] PROCESS FOR FORMING A POURABLE PLASTISOL NITROCELLULOSE SLURRY

[75] Inventors: Craig E. Johnson, Indian Head; Paul F. Dendor, Oxon Hill, both of Md.

[73] Assignee: The United States of America as represented by the Secretary of the Navy, Washington, D.C.

[22] Filed: Aug. 27, 1974

[21] Appl. No.: 500,986

[52] U.S. Cl. ..... 264/3 E; 149/96; 149/111

[51] Int. Cl.[2] ..... C06B 21/00

[58] Field of Search ..... 264/3 R, 3 D, 3 E; 149/96, 100, 111

[56] References Cited

UNITED STATES PATENTS

| | | | |
|---|---|---|---|
| 3,236,702 | 2/1966 | Sapiego | 149/100 X |
| 3,325,315 | 6/1967 | Sapiego | 149/111 X |
| 3,422,170 | 1/1969 | Brooks et al. | 149/100 X |
| 3,671,515 | 6/1972 | Cox et al. | 264/3 D X |
| 3,702,271 | 11/1972 | Henderson et al. | 149/96 X |
| 3,723,207 | 3/1973 | Camp | 149/100 X |

*Primary Examiner*—Samuel W. Engle
*Assistant Examiner*—Peter A. Nelson

[57] ABSTRACT

High shear treatment of a slurry of explosive particles breaks up agglomerates of the explosive particle, forms a stable slurry of fine explosive particles, and tests the slurry for water content.

2 Claims, No Drawings

PROCESS FOR FORMING A POURABLE PLASTISOL NITROCELLULOSE SLURRY

BACKGROUND OF THE INVENTION

This invention relates to explosives and more particularly to a slurry of fine particle explosive solids.

In the forming of a propellant or an explosive, uniformity of components is highly desirable because uniform components contribute to the uniform final product of a propellant or an explosive. Uniformity for the size of each particle of each component used in the explosive or propellant promotes uniform dispersal of each component throughout the propellant or explosive. One of the basic components of an explosive or a propellant is an explosive solid.

Due to the basic characteristic of an explosive solid, one or more types of an explosive solid is added to an explosive formulation or a propellant formulation carefully due to the danger of explosion.

Plastisol nitrocellulose and explosive solids in the dry state are very sensitive to ignition, especially by electrostatic discharge. Thus, it is safer to produce, package, or ship explosives in a liquid slurry form. The slurry form also facilitates handling. Prior to use, it is necessary to dry the slurry. The resultant dried explosive solid is then suitable for use in an explosive formulation or a propellant formulation.

Drying of the explosive solid causes at least two problems. Due to the physical and chemical characteristics of the explosive solid, drying produces large particle or agglomerates many times the size of the original particle. These large agglomerates are usually detrimental to the final physical properties or burning properties of the formulation. Thus it is a definite advantage to have the solid as discrete particles. It is, furthermore difficult to determine when the drying is sufficient, especially drying to remove water. If even a trace of water is left in the explosive solid, possible deleterious results for the propellant or explosive formulation in which the explosive solid is used, including shortened potlife, reduced physical properties, and unstable storage life. Laboratory tests to determine water content are time-consuming and frequently inconvenient.

Thus, there are seemingly conflicting goals. Safety in handling of the explosive solid and a dry solid for formulations conflict. The agglomeration of the dry solid also conflicts with the desired fine particle. It is also difficult to determine just how dry the explosive solid is, or how much water the explosive solid contains. Therefore, it is desirable to form a fine particle plastisol nitrocellulose which does agglomerate and to determine water content of the nitrocellulose.

SUMMARY OF THE INVENTION

Therefore, it is an object of this invention to provide a method for forming fine particle explosive solids.

Also, an object of this invention is to provide a method for forming a stable slurry of fine particle explosive solids.

It is a further object of this invention to provide a method for determining the water content of plastisol nitrocellulose.

These and other objects of the invention are met by a method of subjecting a slurry of an explosive solid to high shear agitation.

DESCRIPTION OF THE PREFERRED EMBODIMENTS

Agglomerates of particles of an explosive solid are broken up by slurrying the partciles in an organic liquid and subjecting the slurry to high shear agitation to form a stable slurry of explosive particles. High shear agitation of plastisol nitrocellulose particles also determines if the water content of the nitrocellulose is low enough for use in propellant or explosive formulations.

The chemical and physical tendency of explosive solids to agglomerate when dried is reduced by subjecting the explosive solids to high shear agitation in a slurry. After this high shear agitation, the tendency to reagglomerate is substantially reduced. The liquid used for the slurry is a volatile hydrocarbon. Standard suitable liquids for use to form the slurry include those listed in U.S. Pat. No. 3,325,315 to Sapiego incorporated herein by reference.

When nitrocellulose is the explosive under treatment, heptane is an especially suitable slurrying liquid because it is readily available in high purity and relatively inexpensive.

While an explosive solid, and specifically any nitrocellulose is treatable by this method, the method is most effective in treating plastisol nitrocellulose such as that disclosed in U.S. Pat. No. 3,671,515 to Cox et al incorporated herein by reference which relates to plastisol nitrocellulose. Agglomeration is reduced by slurrying a product such as that described by the Cox et al patent and subjecting it to high shear agitation. The high shear treatment also serves to determine water content of the nitrocellulose. Up to about 0.6% water by weight of nitrocellulose is acceptable for nitrocellulose to be used in explosive or propellant formulation. If water is present in the nitrocellulose in excess of 0.6%, slurrying action ceases to occur. The slurry becomes so thick that the high shear mixer can produce substantially little or no visible mixing at the surface of the slurry in the mixer. When such a the thick slurry is obtained, there is too much water in the nitrocellulose. At that point, it is possible to redry the nitrocellulose before it is incorporated into a propellant or explosive formulation thereby avoiding the ruining of the whole formulation due to the overwet nitrocellulose. This thickening phenomenon provides a much simpler test for water content than the standard water content test and is made on the production line thereby avoiding production delays.

When the water content is less than 0.6% by weight of nitrocellulose, after high shear agitation, the slurry pours from the container. In fact, after some observation practice, a water content of about 0.4% is observed by examining the way the slurry pours after the high shear agitation. This pourability of the slurry is a much simpler method for determining whether the water content of the plastisol nitrocellulose is at an acceptable level than the presently used methods. Such simplicity substantially eliminates the need for more complex tests and permits an extra drying step to be used if required.

In the following examples which are intended to illustrate without unduly limiting the invention, all parts and percentages are by weight unless otherwise specified.

EXAMPLE I

An example of the invention is: Plastisol Nitrocellulose (PNC) is manufactured as a spherical particles of 13,7 microns in diameter that is suspended in and wetted by 38.5% water. Before it was used (in PBXN-103 — a plastisol formulation), it was tray-dried at 140°F and weighed. When the particles are dry, they form agglomerates of up to 10 centimeters in diameter. Into a 60-quart, stock-pot, 54 pounds of n-heptane are placed. This stock pot is mounted on a high shear, Cowles 5VTV mixer such that the shaft with four-inch impeller attached is centered in the pot and the impeller is located about 3 centimeters from the bottom of the pot. The mixer is started and the speed adjusted in the range of 2000 RPM to 5000 RPM to maintain the slurry in constant motion without excessive splashing. As the agglomerates are broken up by the rapidly rotating blade, the slurry thickened and the agitation speed was increased to the maximum. After ten minutes, a visual observation of the slurry indicates that no significant agglomerates exist, and the mixer is turned off. This slurry was used directly in a plastisol formulation. An independent test on this slurry (as per military standard 286 Karl Fisher test) confirm that the water content was less than 0.4%.

EXAMPLE II

The procedure of Example I is repeated excepting that the drying continues until 1% water is present. During high shear agitation the slurry becomes too thick to mix. The standard test of Example I for water in nitrocellulose confirms the presence of 1% water.

EXAMPLE III

The procedure of Example II is repeated with a drying variation. After high shear agitation the slurry is barely mixable even at 5000 RPM. Independent testing as in Example I confirms the presence of 0.6% water in nitrocellulose.

What is claimed as new and desired to be secured by Letters Patent of the United States is:

1. A method for forming a stable slurry of fine particle plastisol nitrocellulose which comprises:

a. forming a water wet plastisol nitrocellulose which is dried to a water content of up to about 0.6% of water by weight of the plastisol nitrocellulose;

b. adding a suitable liquid to the plastisol nitrocellulose to form a slurry, and c. subjecting the slurry to high shear agitation, and b. examining a sample of the plastisol nitrocellulose slurry to determine the pourability thereof, an unpourable slurry indicating that additional drying is necessary.

2. A method for determining the presence of water in a plastisol nitrocellulose slurry in an amount in excess of 0.6% of water by weight of the nitrocellulose which comprises the steps of:

a. subjecting a slurry of plastisol nitrocellulose in a suitable liquid to high shear agitation; and b. examining a sample of the plastisol nitrocellulose slurry to determine the pourability thereof, a pourable slurry indicating the presence of less than 0.6% of water by weight of the plastisol nitrocellulose, and an unpourable slurry indicating the presence of greater than 0.6% of water by weight of the plastisol nitrocellulose.

* * * * *